US006749698B2

(12) United States Patent
Shimizu et al.

(10) Patent No.: US 6,749,698 B2
(45) Date of Patent: Jun. 15, 2004

(54) PRECIOUS METAL BASED AMORPHOUS ALLOYS

(75) Inventors: Susumu Shimizu, Kanagawa (JP); Kenya Mori, Kanagawa (JP); Shigeo Shioda, Kanagawa (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 0 days.

(21) Appl. No.: 10/088,494

(22) PCT Filed: Aug. 3, 2001

(86) PCT No.: PCT/JP01/06683

§ 371 (c)(1),
(2), (4) Date: Mar. 27, 2002

(87) PCT Pub. No.: WO02/12576

PCT Pub. Date: Feb. 14, 2002

(65) Prior Publication Data

US 2003/0000601 A1 Jan. 2, 2003

(30) Foreign Application Priority Data

Aug. 7, 2000 (JP) ..... 2000-237902
Sep. 1, 2000 (JP) ..... 2000-265510

(51) Int. Cl.[7] ..... C22C 5/04
(52) U.S. Cl. ..... 148/403; 420/466
(58) Field of Search ..... 148/403; 420/466

(56) References Cited

FOREIGN PATENT DOCUMENTS

| | | |
|---|---|---|
| EP | 801151 | 4/1997 |
| JP | 7-310149 | 11/1995 |
| JP | 2000-50923 | 2/2000 |
| JP | 2001-256811 | 9/2000 |

OTHER PUBLICATIONS

Yamanashi–ken, Kogyo Gijutsu Center Kenkyuu Houkoku, No. 13, pp. 111 to 114, (1999) Miyagawa et al., "Amorphous Kikinzoku Sozai no Chuuzou Jouken to Jitsuyou–kani Kansuru Kenkyuu", especially, Shogen (introduction); table 1, Jan. 18, 2000.

*Primary Examiner*—Deborah Yee
(74) *Attorney, Agent, or Firm*—Rothwell, Figg, Ernst & Manbeck

(57) ABSTRACT

The present invention is a precious metal-based amorphous alloy having a Pt—Cu—P based structure including in atomic %: 50≦Pt≦75%, 5≦Cu≦35%, and 15≦P≦25% and is a precious metal-based amorphous alloy having a Pt—Pd—Cu—P based structure including in atomic %: 5≦Pt≦70%, 5≦Pd≦50%, 5≦Cu≦50%, and 5≦P≦30%. Preferably, cooling rates for manufacturing the alloys having these compositions are $10^{-1}$ to $10^{2}$° C./sec. for the Pt—Cu—P based structure and $10^{1}$ to $10^{2}$° C./sec. for the Pt—Pd—Cu—P based structure.

2 Claims, 1 Drawing Sheet

PRECIOUS METAL BASED AMORPHOUS ALLOYS

TECHNICAL FIELD TO WHICH THE INVENTION PERTAINS

The present invention relates to a precious metal-based amorphous alloy used as a material for accessories or medical devices. Specifically, the present invention relates to a precious metal-based amorphous alloy rich in precious metal components and free of nickel which may have an influence on the human body.

BACKGROUND ART

Precious metals such as platinum and palladium have been used for medical devices such as dental instruments and catheters in addition to accessories such as rings, necklaces and pendants. Each of the materials used for these applications is required to have a higher hardness because the material needs to be prevented from scoring which is caused by the friction in use. A pure precious metal, which is soft and vulnerable, is generally alloyed with a small amount of other metal elements when the precious metal is used as a material for the accessories and the medical devices. However, thus prepared precious metal alloys do not always have a fully satisfying property in terms of hardness.

A crystal structure of an amorphous alloy which is also referred to as a super-cooled metal or a glass metal is different from that of a general metal material, and this amorphous alloy is a material having a random atomic arrangement throughout the wide range. This structure provides some features that defects which would otherwise exist in its crystal structure (grain boundaries, dislocations) can not be seen, that its physical characteristics such as strength show specific tendencies, and that particularly its hardness becomes extremely high. This amorphous alloy is manufactured by super-quenching the liquid state alloy, so that the cooling rate in this case is required to be at an adequate level for inhibiting the production of crystal nuclei and their growth (a critical cooling rate) (for example, a critical cooling rate for a precious metal alloy is approximately $10^2$ to $10^{4}$° C./sec. and critical cooling rates for other alloys are approximately $10^5$ to $10^{6}$° C./sec.) Such a limitation on the cooling rate has so far resulted in a restriction of a size of the amorphous alloy which can be manufactured, that is, only some types of materials including foil-like, needle-like, and flake-like materials can be manufactured, so that it has been difficult to use these alloys industrially.

However, with respect to an alloy metal having a predetermined composition, it has been recently found out that its material structure can be made into an amorphous state even at a relatively low cooling rate. This results in the manufacture of a bulky (ingot-like) and thick amorphous alloy which is larger than the size of the hitherto known amorphous alloy such as a foil type material. As an alloy composition having such an ability of forming the amorphous state, various kinds of alloys have already been known. And applications of the amorphous alloys to the above described materials for accessories or medical devices, for example, are now under investigation.

As an example of studying an amorphous alloy which contains a precious metal, for example, a Pd—Ni—P based amorphous alloy (in atomic %, Pd 40%, Ni 40%, and P 20%) is described in Japanese Patent Laid-Open No. 59-35417 as one of the transition metal-semi metal based amorphous alloys. Using the precious metal alloy having this composition, it has been demonstrated that the amorphous alloy about 5 mm in thickness can be manufactured even by the metal mold casting. In addition, Japanese Patent Laid-Open No. 9-195017 describes a Pt—Pd—Cu—Si based amorphous alloy (in atomic %, Pt+Pd: 65 to 80%, Cu: 0 to 15%, and Si: 10 to 20%) and discloses that the precious metal alloy having this composition can also be made into a bulk of 100 mm in length and 1 mm in diameter.

However, these conventional amorphous alloys containing the precious metals are insufficient when considering their applications to the materials used for the accessories and the medical devices as described above. For example, the accessory is frequently desired to have an asset value as its aspect, and this asset value is commonly supposed to become greater in proportion to an amount of the precious metal contained in the accessory. Many of the conventional amorphous alloys contain less precious metals, so that in this respect it can hardly be said that these amorphous alloys are suitable for the materials used for the accessories.

In addition, many of the above described conventional precious metal -based amorphous alloys contain nickel as their components, but nickel is an element whose influence on the human body such as an metal allergy and carcinogenesis is worried. Therefore, it can be considered that these conventional amorphous alloys are not favorable to be used for substances which are in contact with the human skin continuously such as accessories and for substances which are in contact with the internal tissue of the human body of the human such as medical devices.

The present invention has developed under the background as described above, and an object of the present invention is to provide an amorphous alloy which is rich in precious metals and is completely free of nickel provided that a bulk having an amorphous structure can be formed even when the alloy is solidified at a relatively low cooling rate.

DISCLOSURE OF THE INVENTION

The inventors have intensively made an effort to develop a precious metal-based amorphous alloy by which the above described problems can be solved. Specifically, the inventors have achieved the present invention as a result of selecting platinum as the precious metal which constitutes a principal component of the alloy, platinum being the most common material for accessories, to allow platinum to be contained at a level of 50% or more of the alloy, as well as selecting Cu and P as additional elements which have the ability to form the amorphous structure, and variously changing the concentrations of theses elements to investigate the respective structures of the alloys.

A first precious metal-based amorphous alloy according to the present application is a precious metal-based amorphous alloy with a Pt—Cu—P based structure comprising $50\% \leqq Pt \leqq 70\%$ by atom, $5\% \leqq Cu \leqq 35\%$ by atom, and $15\% \leqq P \leqq 25\%$ by atom.

A second precious metal-based amorphous alloy according to the present application is a precious metal-based amorphous alloy with a Pt—Pd—Cu—P based structure comprising $5\% \leqq Pt \leqq 70\%$ by atom, $5\% \leqq Pd \leqq 50\%$, $5\% \leqq Cu \leqq 50\%$ by atom, and $5\% \leqq P \leqq 30\%$ by atom.

An exact mechanism of forming the amorphous structure with respect to these two kinds of precious metal alloys according to the present invention is not completely revealed, but it is supposed that copper and phosphorus both of which are additional elements have some effects of raising the crystallization temperature of the alloy and of expanding the temperature range of a super-cooled liquid (a difference between the crystallization temperature and the glass transition temperature) of the above described alloy, so that the ability of forming the amorphous structure is improved.

In addition, the precious metal-based alloy with the Pt—Cu—P based structure and the precious metal-based alloy with the Pt—Pd—Cu—P based structure according to the present invention can be made into amorphous states even when their cooling rates are relatively low by, as for the Pt—Cu—P based structure, defining a range of copper concentration as $5\% \leqq Cu \leqq 35\%$ and a range of phosphorus concentration as $15\% \leqq P \leqq 25\%$ provided that a concentration of platinum is 50% or more and 75% or less and by, as for the Pt—Pd—Cu—P based structure, defining a range of copper concentration as $5\% \leqq Cu \leqq 50\%$ and a range of phosphorus concentration as $5\% \leqq P \leqq 30\%$ provided that a concentration of platinum is 5% or more and 70% or less and a concentration of palladium is 5% or more and 50% ore less. That is, if at least one of these constituents becomes outside of the above described range, the alloy is crystallized and its amorphous structure can not be obtained.

Although the precious metal-based amorphous alloys according to the present invention can be made into a bulky material even when the alloy is cooled at a relatively low cooling rates such as $10^{2}$° C./sec. or less, the alloy has a preferable cooling rate in order to more reliably obtain its amorphous structure. For example, in particular, a cooling rate for the Pt—Cu—P based structure is preferably from $10^{-1}$ to $10^{2}$° C./sec., and a cooling rate for the Pt—Pd—Cu—P structure is preferably from $10^{1}$ to $10^{2}$° C./sec. The amorphous alloy which has been cooled at this cooling rate is the precious metal-based alloy which has been completely made into its amorphous state because the cooling rate during its solidification is defined within an appropriate range. The amorphous alloy according to the present invention which is thus completely made into its amorphous state has an extremely high hardness and is suitable for a material used for accessories or medical devices.

The precious metal-based amorphous alloy according to the present invention can contain up to 75% or 70% of platinum. Therefore, if the alloy is used for the accessories, an amount of the platinum contained therein can be expected to provide the accessories with the asset values. In addition, the precious metal-based amorphous alloy according to the present invention is completely free of nickel as is evident from its composition, so that the alloy is supposed to have no effects on the human body which would otherwise cause metal allergy or carsinogenesis. In this respect, it also becomes possible to use the alloy for accessories and medical devices.

In addition, when each of the Pt—Cu—P based amorphous alloy and the Pt—Pd—Cu—P based amorphous alloy according to the present invention is made into its final product shape through casting, a surface of the alloy after being solidified becomes smooth, so that the alloy can be used as a product as it is. In addition, the plastic workability of the amorphous alloy according to the present invention depends on its composition, but in the case where the alloy needs to be subjected to the strong working, its workability can be retained by heating the alloy to a certain temperature between its glass transition temperature and its crystallization temperature (a supercooling liquid temperature range) for performing the working. This results from a superplasticity phenomenon which is caused by an abrupt reduction in a viscosity of the amorphous alloy due to the heating.

As a method for manufacturing the precious metal-based amorphous alloy according to the present invention, the alloy can be manufactured by mixing each metal and phosphorus within a predetermined range of the composition and by quenching the molten metal with this composition before solidifying the molten metal. When raw materials are mixed with and melted into each other, it is preferable to use powdery raw materials in order to promote the melting process. In this case, Cu which is in a pure metal state can be added, but Cu which is in a state of a copper-phosphide compound ($Cu_3P$ and the like) can be added in order to make fine adjustments of the phosphorus concentration. Further, when these metals are allowed to be melted, it is preferable to add borax in order to prevent the alloy from oxidation. Although there is no particular problem about a method which is to be performed for quenching the alloy after the melting, a method for rapidly casting the alloy into a copper mold after the alloy is melted in a crucible being made of quartz for example or a method for dipping a crucible in water is given as an example of the methods being capable of cooling the alloy at a cooling rate which is within a favorable range of temperature for each of the above described alloy structure ($10^{-1}$ to $10^{2}$° C./sec. for the Pt—Cu—P based structure and $10^{1}$ to $10^{2}$° C./sec. for the Pt—Pd—Cu—P based structure).

MODE FOR CARRYING OUT THE INVENTION

Figure 1:
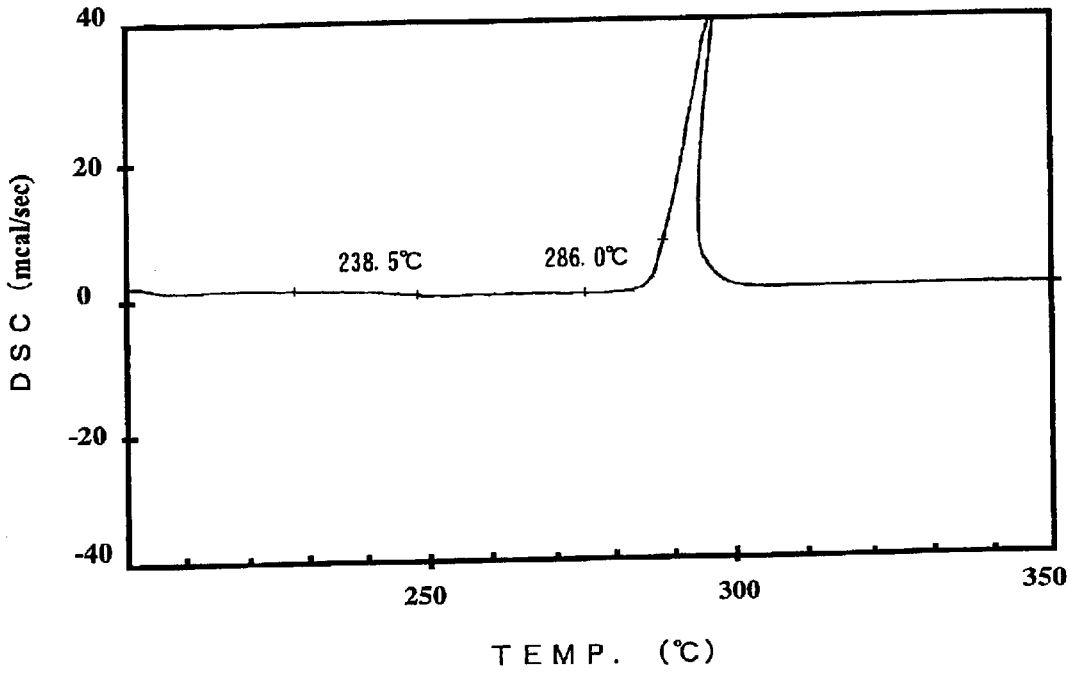
FIG. 1 shows a DSC curve of a specimen No. 7 (Pt: 60 at %, Cu: 20 at %, P: 20 at %).

Preferable embodiments according to the present invention will now be described below with reference to the drawings. In the present embodiment, two kinds of precious metal-based amorphous alloys, one of which being Pt—Cu—P based structure and the other of which being Pt—Pd—Cu—P based structure, were manufactured, and a degree of amorphous state (hereinafter referred to as a vitrification degree) and a hardness of each of the alloys was measured to determine a composition range of the alloy having an amorphous structure.

EXAMPLE 1

In this example, Pt—Cu—P based amorphous alloys having different compositions were manufactured. After platinum powder, powdery red phosphorus, and small bulky copper phosphide ($Cu_3P$) were weighed so that a total amount of these materials became 100 g in order to obtain a composition described in Table 1 and mixed with each other, 5 g of borax were further added to the mixture, then the mixture was placed in a one-side sealed-off silica tube having an inner diameter of 20 mm to heat it within an electric furnace in an atmosphere of argon and allow the materials to be melted. The melting temperature was determined to be 1100° C., and after the materials were melted at this temperature, an argon gas was blown into the molten metals and bubbling was allowed to be generated for one minute in order to stir and degas of the molten metals. Next, this molten metal was cast into a copper mold whose recess was in a ring shape (20 mm in outer diameter, 15 mm in inner diameter, and 50 mm in depth), and quenched and solidified to manufacture a ring shaped amorphous alloy.

With respect to each of the amorphous alloys thus manufactured, after the alloy was cut into a predetermined dimension, a differential thermal analysis was conducted, then a vitrification degree of each alloy was investigated while measuring its glass transition temperature and crystallization temperature. In this case, the differential thermal analysis was conducted by heating this alloy assuming that the weight of each amorphous alloy was constant within a range of 100 mg±10 mg, and the vitrification degree was determined from a height of an exothermic peak which may appear during the crystallization. For example, a specimen No. 7 (Pt: 60 at %, Cu: 20 at %, P: 20 at %) of FIG. 1 shows that its glass transition temperature is 238.5° C. and its crystallization temperature is 286.0 C. In addition, after this determination of the vitrification degree was performed, a Vickers hardness of each alloy described above was measured. Both results of measuring the vitrification degree and the Vickers hardness with respect to each alloy described above are shown in Table 1.

TABLE 1

| Specimen | Element concentration (at %) | | | Degree of vitrification | Vickers |
|---|---|---|---|---|---|
| No. | Pt | Cu | P | (Note) | hardness |
| 1 | 50 | 35 | 15 | ○ | 450 |
| 2 | 50 | 30 | 20 | ◎ | 420 |
| 3 | 50 | 25 | 25 | ○ | 450 |
| 4 | 50 | 40 | 10 | × | 500 |
| 5 | 50 | 20 | 30 | × | 520 |
| 6 | 60 | 25 | 15 | ○ | 440 |
| 7 | 60 | 20 | 20 | ◎ | 410 |
| 8 | 60 | 15 | 25 | ○ | 450 |
| 9 | 60 | 30 | 10 | × | 510 |
| 10 | 60 | 10 | 30 | × | 500 |
| 11 | 70 | 15 | 15 | ○ | 430 |
| 12 | 70 | 10 | 20 | ◎ | 400 |
| 13 | 70 | 5 | 25 | ○ | 450 |
| 14 | 70 | 20 | 10 | × | 500 |
| 15 | 70 | 0 | 30 | × | 550 |
| 16 | 75 | 10 | 15 | ○ | 450 |
| 17 | 75 | 5 | 20 | ◎ | 420 |
| 18 | 75 | 0 | 25 | × | 490 |
| 19 | 75 | 15 | 10 | × | 500 |

◎: Completely vitrified
○: Almost vitrified
X: Crystallization

As a result of this, an amorphous alloy having a composition within a range recited in claim 1 had a good vitrification degree and could be easily made into an amorphous structure, in addition, the alloy whose hardness is higher than a hardness of a platinum pure metal or a platinum alloy could be obtained. Every alloy was excellent in its gloss.

Also, the specimen No. 7 had a density of 15.39 g/cc. Investigating the mechanical characteristics of this specimen No. 7 which was molded into a ring shape having an outer diameter of 20.0 mm, an inner diameter of 16.0 mm, and a width of 3.0 mm, its compressive strength was 56 kg/cm$^2$. This alloy may have inscriptions thereon and its hardness and compressive strength are both higher than the platinum alloy, so that this alloy is considered to be suitable for the materials used for accessories.

EXAMPLE 2

In this example, Pt—Pd—Cu—P based amorphous alloys which had different compositions described in Table 2 were manufactured. As is the case with Example 1, after platinum powder, powdery palladium, powdery red phosphorus, and small bulky copper phosphide ($Cu_3P$) were weighed so that a total amount of these materials became 100 g in order to obtain a composition described in Table 2 and mixed with each other, 5 g of borax were further added to the mixture, then the mixture was placed in a one-side sealed-off silica tube having an inner diameter of 20 mm to heat it within an electric furnace at 1100° C. in an atmosphere of argon and allowed the materials to be melted. An argon gas was blown into the molten metals and bubbling was allowed to be generated for one minute. Next, this molten metal was dipped in water together with the silica tube, and quenched and solidified to manufacture a rod-like amorphous alloy.

After each of these amorphous alloys was cut into a predetermined dimension, a differential thermal analysis was conducted, then a vitrification degree of each alloy was investigated while measuring its glass transition temperature and crystallization temperature. Analytical conditions were the same as in the case of Example 1. Both results of measuring the vitrification degree and the Vickers hardness with respect to each alloy manufactured in this example are both shown in Table 2.

TABLE 2

| Specimen | Element concentration (at %) | | | | Degree of vitrification | Vickers |
|---|---|---|---|---|---|---|
| No. | Pt | Pd | Cu | P | (Note) | hardness |
| 20 | 10 | 30 | 40 | 20 | ○ | 490 |
| 21 | 10 | 40 | 30 | 20 | ◎ | 480 |
| 22 | 10 | 50 | 20 | 20 | ○ | 500 |
| 23 | 10 | 60 | 10 | 20 | × | 600 |
| 24 | 20 | 20 | 40 | 20 | ○ | 510 |
| 25 | 20 | 30 | 30 | 20 | ◎ | 470 |
| 26 | 20 | 40 | 20 | 20 | ◎ | 460 |
| 27 | 20 | 50 | 10 | 20 | × | 590 |
| 28 | 30 | 10 | 40 | 20 | ○ | 510 |
| 29 | 30 | 20 | 30 | 20 | ◎ | 450 |
| 30 | 30 | 30 | 20 | 20 | ◎ | 450 |
| 31 | 30 | 40 | 10 | 20 | ○ | 500 |
| 32 | 39 | 2 | 39 | 20 | × | 580 |
| 33 | 40 | 10 | 30 | 20 | ○ | 510 |
| 34 | 40 | 20 | 20 | 20 | ◎ | 460 |
| 35 | 40 | 30 | 10 | 20 | ○ | 500 |
| 36 | 39 | 39 | 2 | 20 | × | 580 |
| 37 | 2.5 | 40 | 37.5 | 20 | × | 590 |
| 38 | 5 | 40 | 35 | 20 | ○ | 520 |
| 39 | 7.5 | 40 | 32.5 | 20 | ○ | 530 |
| 40 | 25 | 30 | 25 | 20 | ◎ | 470 |
| 41 | 21 | 26 | 21 | 32 | × | 590 |
| 42 | 23 | 29 | 23 | 25 | ○ | 520 |
| 43 | 27 | 31 | 27 | 15 | ○ | 510 |
| 44 | 29 | 34 | 29 | 8 | × | 600 |
| 45 | 50 | 10 | 20 | 20 | ○ | 530 |
| 46 | 50 | 20 | 10 | 20 | ○ | 490 |
| 47 | 60 | 10 | 10 | 20 | ○ | 520 |
| 48 | 65 | 5 | 10 | 20 | ○ | 500 |
| 49 | 70 | 5 | 5 | 20 | ○ | 510 |

◎: Completely vitrified
○: Almost vitrified
×: Crystallization

As a result of this, an amorphous alloy having a composition within a range recited in claim 2 had a good vitrification degree and could be easily made into an amorphous structure. In addition, the alloy having a higher hardness was obtained and each alloy was excellent in its gloss.

After a specimen No. 30 (from the results of measurement, its glass transition temperature was 238.5° C. and its crystallization temperature was 286.0 C.) was heated to 35° C. and subjected to a tensile test, the specimen was readily and highly elongated to become a thin linear shape.

INDUSTRIAL APPLICABILITY

As described above, a precious metal-based amorphous alloy according to the present invention can be expected to have an asset value when the alloy is used for accessories because a concentration of the precious metal contained in the alloy is high. In addition, since the precious metal-based amorphous alloy according to the present invention is completely free of nickel and has no bad influences on the human body, the alloy can also be expected to be used for the accessories for this reason. Similarly, the alloy is also applicable to medical instruments.

The precious metal-based amorphous alloy according to the present invention has a property of being able to be made into a bulk having an amorphous structure even when the alloy is solidified at a relatively low cooling rate in addition to other properties described above, so that the precious metal-based amorphous alloy according to the present invention can be manufactured into essentially scratch-proof accessories and medical devices by making full use of an inherent property of this amorphous alloy such as a high hardness.

What is claimed is:

1. A precious metal-based amorphous alloy having a Pt—Cu—P based structure, wherein said alloy comprises in atomic %, $50 \leqq Pt \leqq 75\%$, $5 \leqq Cu \leqq 35\%$, and $15 \leqq P \leqq 25\%$.

2. The precious metal-based amorphous alloy according to claim 1, wherein said alloy is obtained through solidifying the amorphous alloy in a molten state at a cooling rate of $10^{-1}$ to $10^{2}$ C./sec.

* * * * *